US005647789A

United States Patent [19]

Kitta et al.

[11] Patent Number: 5,647,789

[45] Date of Patent: Jul. 15, 1997

[54] POLISHING MACHINE AND A METHOD OF POLISHING A WORK

[75] Inventors: Satoru Kitta; Masanori Furukawa, both of Nagano, Japan

[73] Assignee: Fujikoshi Kakai Kogyo Kabushiki Kaisha, Nagano-ken, Japan

[21] Appl. No.: 226,522

[22] Filed: Apr. 12, 1994

[30] Foreign Application Priority Data

Nov. 1, 1993 [JP] Japan ..... 5-273595

[51] Int. Cl.[6] ..... B24B 7/22

[52] U.S. Cl. ..... 451/41; 451/288

[58] Field of Search ..... 451/283, 285, 451/286, 287, 288, 289, 291, 41

[56] References Cited

U.S. PATENT DOCUMENTS

| | | | |
|---|---|---|---|
| 2,033,922 | 3/1936 | Cole | 451/287 |
| 3,004,371 | 10/1961 | Layton et al. | 451/283 |
| 3,101,575 | 8/1963 | Schultz | 451/283 |
| 3,110,988 | 11/1963 | Boettcher | 451/286 |
| 3,161,966 | 12/1964 | Roshong | 451/286 |
| 3,931,696 | 1/1976 | Lorenz et al. | 451/288 |

*Primary Examiner*—Robert A. Rose
*Attorney, Agent, or Firm*—Jordan and Hamburg

[57] ABSTRACT

The object of the invention is to provide a polishing machine, which are capable of making the degree of plane higher. The polishing machine comprises: a polishing plate for polishing a work, which is pressed thereon, the polishing plate being capable of rotating; and a driving mechanism for rotating the polishing plate, characterized in that the driving mechanism is capable of rotating the polishing plate in one direction and the other direction. In the polishing machine, since the work is polished by rotating the polishing plate in the one direction, then rotating it in the other direction, slury concentrated at a specific position of the work can be scattered, so that the work can be polished uniformly and the degree of plane can be higher.

21 Claims, 10 Drawing Sheets

POLISHING MACHINE AND A METHOD OF POLISHING A WORK

BACKGROUND OF THE INVENTION

The present invention relates to a polishing machine for polishing a work and a method of polishing a work.

Conventionally, polishing machines for polishing surfaces of works, e.g., silicon wafers, have been known. In a conventional polishing machine for polishing silicon wafers, the wafers are stuck onto a lower face of a carrying plate with wax. The carrying plate is fed onto a polishing plate whose upper face is covered with polishing cloth. The carrying plate with the wafers is pressed onto the upper face of the polishing plate by a pressing head. The polishing plate is rotated in one direction so as to polish lower faces of the wafers. During the rotation, slurry is supplied onto the polishing cloth on the upper face of the polishing plate. Thus, the lower faces of the wafers can be polished. Note that, in the present invention, the general idea of "polishing" includes so-called "lapping".

Each wafer has an orientation flat, a notch, etc. for indicating crystallographic axes thereof.

FIG. 12 is a plan view of a conventional polishing machine. A drive shaft is rotatably extended upward from a center part of a polishing plate 2. There is provided a center roller 3 at a front end of the drive shaft. There is provided a guide roller 4 in the vicinity of a circumferential edge of the polishing plate 2. When the polishing plate 2 is rotated in a direction X, a carrying plate 5, which is held by the center roller 3 and the guide roller 4, rotates on its axis. The carrying plate 5 rotates in a direction M. The carrying plate 5 is pressed onto the polishing plate 2 by a press head (not shown). By the rotation of the carrying plate 5, silicon wafers 6 stuck on a lower face of the carrying plate 5 are polished.

In the conventional machine, the wafers 6 are stuck on the lower face of the carrying plate 5 with wax, but the wafers 6 may be held on a lower face of the press head by a vacuum. A template having circular concave sections is provided on a lower face of the carrying plate 5 wherein the wafers 6 are held in the concave sections by water surface tension. In this case, the carrying plate 5 with the template is also pressed onto the polishing plate by the press head.

However, the conventional polishing machine has following disadvantages.

While the polishing plate 2 rotates in the direction X, the carrying plate 5 rotates in the direction M only, so that the slury is apt to be collected in the vicinity of a linear orientation flat. Especially, the slury is concentrated in a corner section 6*c* of the orientation flat. Therefore, degree of plane must be lower in the section 6*c*. Since the edge of the wafer 6, aside from the linear orientation flat or the notch, is formed into a circular shape, the slurry is discharged therefrom by the rotation of the wafer 6. On the other hand, the slurry is apt to be collected in said part as described above.

In the machine employing the carrying plate 5 with the template, since the concave sections have circular forms, there is formed a gap between an inner circumferential face of each concave section and the linear orientation flat of each wafer 6. With the gap, the slury is apt to be collected in the gap, so that the degree of plane of the wafer 6 must be lower in the vicinity of the orientation flat.

Presently, signal lines formed in silicon chips for ICs are required to be thinner and thinner. However, if the degree of plane is lower, the signal lines formed by a photolithographic method are thicker.

SUMMARY OF THE INVENTION

An object of the invention is to provide a polishing machine and a method of polishing a work, which are capable of making the degree of plane higher.

To achieve the object, the polishing machine of the present invention comprises:

a polishing plate for polishing a work, which is pressed thereon, the polishing plate being capable of rotating; and a driving mechanism for rotating the polishing plate, characterized in that, the driving mechanism is capable of rotating the polishing plate in one direction and the other direction.

The polishing machine may further comprises a press head for pressing the work onto the polishing plate, the polishing plate being capable of holding the work.

And the machine may further comprises:

a center roller being capable of rotating coaxial with the polishing plate;

a first guide roller being provided in the vicinity of the polishing plate, the first roller being capable of rotatably pinching the holding member with the center roller while the polishing plate rotates in the one direction; and a second guide roller being provided in the vicinity of the polishing plate, the second roller being capable of rotatably pinching the holding member with the center roller while the polishing plate rotates in the other direction.

On the other hand, the method of polishing the work comprises the steps of:

pressing the work onto a polishing plate, which is capable of rotating in one direction and the other direction;

rotating the polishing plate in the one direction; and rotating the polishing plate in the other direction.

In the polishing machine and a method of polishing the work of the present invention, since the work is polished by rotating the polishing plate in the one direction, then rotating it in the other direction, the slurry concentrated at a specific position of the work can be scattered, so that the work can be polished uniformly and the degree of plane can be higher.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described with reference to the accompanying drawings. Note that, polishing machines for polishing silicon wafers, which are an example of the workpiece, will be explained as the embodiments.

Firstly, a first embodiment will be explained with reference to FIGS. 1–6.

Figure 1:
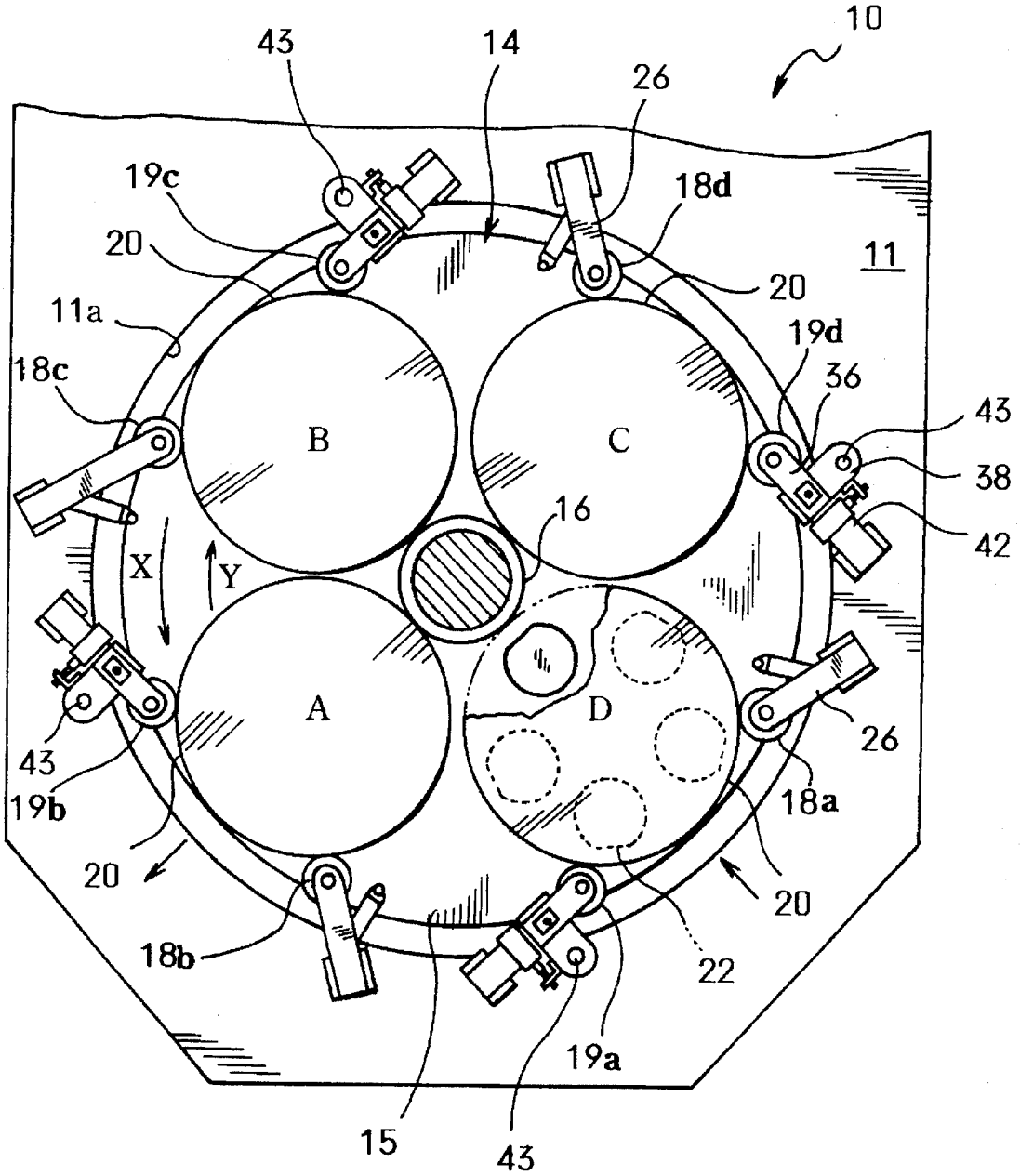
FIG. 1 is a partial plan view showing a polishing plate of the polishing machine of a first embodiment.
Figure 2:
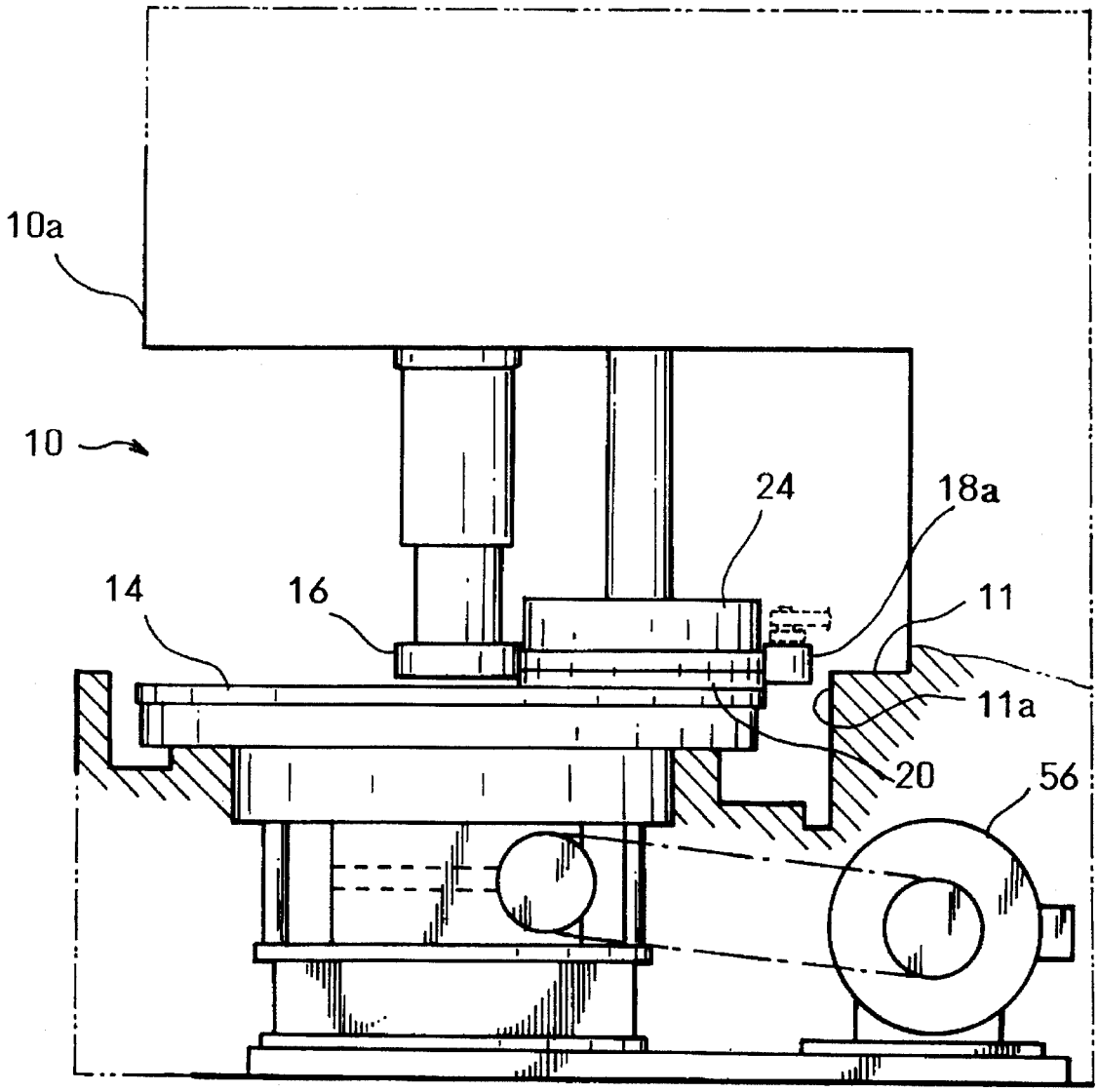
FIG. 2 is a side view of the machine.

FIG. 1 is a partial plan view showing a polishing plate of the polishing machine, and FIG. 2 is a side view thereof.

A polishing plate 14 is rotatably provided in a concave section 11*a*, which is formed in a base 11 of the polishing machine 10. The polishing plate 14 is rotated by a motor 56, which is capable of rotating in one direction and the other direction. Thus, the polishing plate 14 is capable of rotating in one direction X and the other direction Y. The rotational direction of the polishing plate 14 is defined by switching the rotational direction of the motor 56.

A center roller 16 is rotatably provided to be coaxial with the polishing plate 14. The center roller 16 is rotatably suspended by a head section 10*a*, which is located above the polishing plate 14.

There are provided four guide roller sets in the vicinity of the polishing plate 14. The guide roller sets respectively have a pair of guide rollers 18*a* and 19*a*; 18*b* and 19*b*; 18*c* and 19*c*; and 18*d* and 19*d*. Carrying plates 20, which are an example of holding members, can be rotatably held by the center roller 16 and the guide roller sets.

There are stuck a plurality of silicon wafers 22, which are an example of workspieces, on a lower face of each carrying plate 20. Note that, in FIG. 1, the polishing plate 14 is capable of operating on four carrying plates 20, and each carrying plate 20 is capable of holding five wafers 22. Each carrying plate 20 holding the wafers 22 is held between the center roller 16 and the guide roller set, and pushed downward by a press head 24.

Four press heads 24 (one of them is shown in FIG. 2) are suspended by the head 10*a*. Each press head 24 is capable of vertically moving and rotating with respect to the head 10*a*. A weight member (not shown) is accommodated in each press head 24 so as to press the carrying plates 20. When the polishing plate 14 is rotated by the motor 56, the carrying plates 20 held by the center roller 16 and the guide roller sets and the press heads 24 pressing the carrying plates 20 onto the polishing plate 14 are rotated about their axes, so that lower faces of the wafers 22 are polished.

A sheet of polishing cloth 15 is provided on an upper face of the polishing plate 14. Slurry is supplied onto the polishing cloth 15 to polish the wafers 22.

In FIGS. 1 and 2, each carrying plate 20 is held between the center roller 16 and each guide roller set. As described above, the polishing plate 14 is capable of rotating in the directions X and Y. When the polishing plate 14 is rotated in the direction X, the carrying plates 20 are rotatably held between the center roller 16 and the guide rollers 18*a*, 18*b*, 18*c* and 18*d*. On the other hand, when the polishing plate 14 is rotated in the direction Y, the carrying plates 20 are rotatably held between the center roller 16 and the guide rollers 19*a*, 19*b*, 19*c* and 19*d*.

Figure 3:
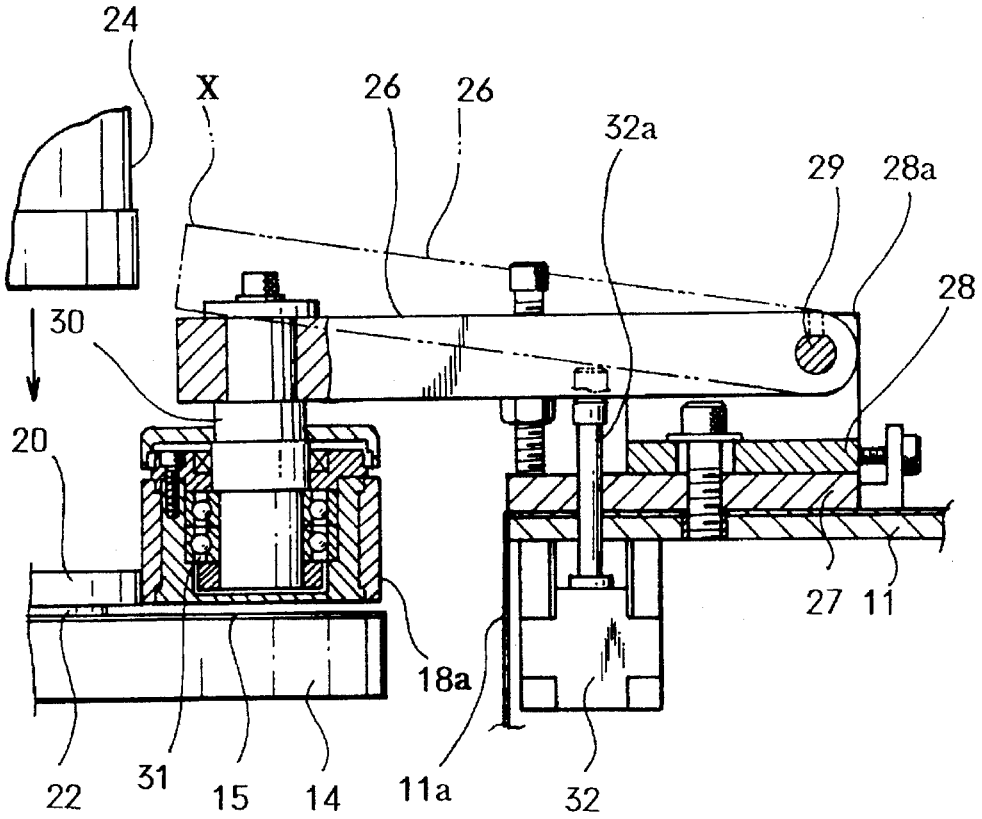
FIG. 3 is a sectional view of a first guide roller.
Figure 4:
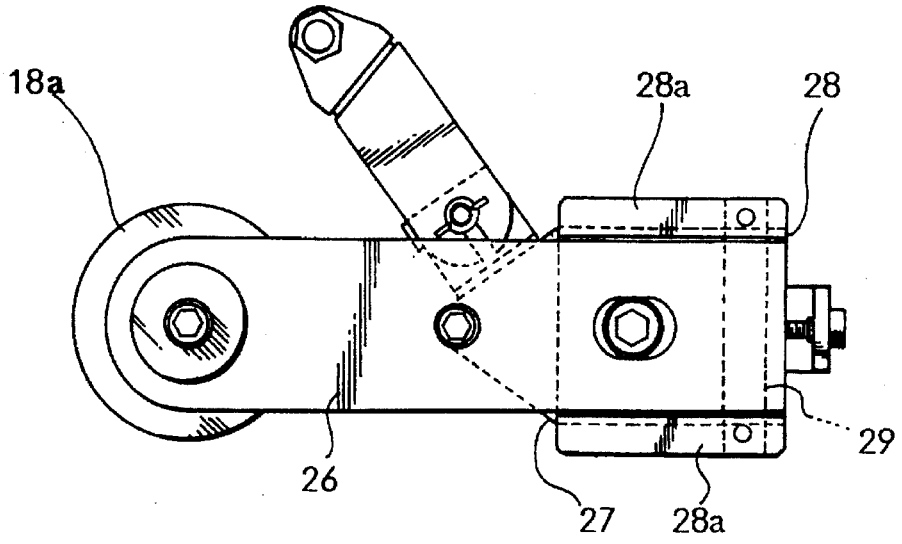
FIG. 4 is a plan view of the first guide roller.

Next, the guide rollers 18*a*, which hold the carrying plate 20 when the polishing plate 14 rotates in the direction X, are explained with reference to FIGS. 3 and 4. The guide rollers 18*b*, 18*c* and 18*d* have the same structure, so explanation of their structure will be omitted.

The guide roller 18*a* is provided in the vicinity of an outer edge of the polishing plate 14. The guide roller 18*a* is suspended by a suspending arm 26. A rear end section of the suspending arm 26 reaches the base 11 of the polishing machine 10. There is fixed a fixed base 28, shown in FIGS. 3 and 4, on the base 11 supported on a fixed base 27. A position of the base plate 28 with respect to the polishing plate 14 can be precisely adjusted. The base plate 28 has a U shaped cross section. The rear end section of the suspending arm 26 is rotatably attached to a shaft 29, which is spanned between side plates 28*a* of the U-shaped base plate 28. The shaft 29 is arranged parallel to the base 11.

There is provided a shaft 30 at a front end of the suspending arm 26. The shaft 30 is arranged at a right angle to the suspending arm 26. The guide roller 18*a* is rotatably provided at a lower section of the shaft 30 by a ball bearing 31. A cylinder unit 32 is disposed in the base 11. A rod 32*a* of the cylinder unit 32 maintains contact with a lower face of a mid part of the suspending arm 26. Thus, if the rod 32*a* is extended upward, the suspending arm 26 rotates on the shaft 29 in the clockwise direction, so that the guide roller 18*a* leaves the polishing plate 14. This position of the guide roller 18*a* is a free position, shown by two-dot chain lines in FIG. 3. When the guide roller 18*a* is located at the free position, the carrying plate 20 is not held by the center roller 16 and the guide roller 18*a*, and is capable of rotating together with the polishing plate 14.

On the other hand, if the suspending arm 26 is in a horizontal status, the guide roller 18*a* is lowered and disposed at a holding position. The guide roller 18*a* at the holding position is shown by solid lines in FIG. 3. When the guide roller 18*a* is located at the holding position, the carrying plate 20 is rotatably held by the center roller 16 and the guide roller 18*a*.

The guide roller 19*a*, holds the carrying plate 20 when the polishing plate 14 rotates in the direction Y, as is explained with reference to FIGS. 5 and 6. Note that, the guide rollers 19*b*, 19*c* and 19*d* have same structure as the guide roller, so explanation of their structure will be omitted.

The guide roller 19*a* is also provided in the vicinity of the outer edge of the polishing plate 14. Referring in FIGS. 5 and 6, guide roller 19*a* is suspended by a suspending arm 36. There is provided a shaft 40 at a front end of the suspending arm 36. The shaft 40 arranged at a right angle to the suspending arm 36. The guide roller 19*a* is rotatably provided at a lower section of the shaft 40 with a ball bearing (not shown) as well as the guide rollers 18*a*, 18*b*, 18*c* and 18*d*. A rear end section of the suspending arm 36 is rotatably attached to a shaft 39, which is provided in a groove 38*a* formed at a front end of a rotatable arm 38.

A cylinder unit 50 is disposed on the suspending arm 36, on the front side with respect to the shaft 30. A rod 50*a* of the cylinder unit 50 passes through a vertical through-hole 36*a* bored in the suspending arm 36. Thus, a front end of the rod 50*a* pushes an inner bottom face of the groove 38*a* to rotate the suspending arm 36 on the shaft 39 in the counterclockwise direction if the rod 50*a* is extended downward.

The suspending arm 36 and the rotatable arm 38 are arranged to cross at a right angle, and a rear end of the rotatable arm 38 is rotatably attached to a shaft 43, which is extended upward from a base arm 42, with a bearing. A rear end of the base arm 42 reaches the base 11 of the machine 10. There is bored a long hole 42*b* in a rear end section of the base arm 42. The base arm 42 is fixed on the base 11 by bolts 49, which are pierced through the long hole 42*b*. Movement of the base arm 42 is limited by a pair of guide pieces 41, which are fixed on the base 11.

There is provided a cylinder unit 44 on the base arm 42. A rod 45 of the cylinder unit 44 is capable of extending and retracting in the direction perpendicular to the longitudinal direction of the base arm 42. The cylinder unit 44 is capable of rotating the rotatable arm 38 on the shaft 43. An operating piece 46 is fixed on a side face of the rotatable arm 38. A long through-hole 46*a* extends through the operating piece 46, and a pin 47, which is provided at a front end of the rod 45 is passed through the long hole 46*a*. Thus, when the rod 45 of the cylinder unit 44 is extended and retracted, the rotatable arm 38 is rotated on the shaft 43 together with the the suspending arm 36 and the guide roller 19*a*.

Figure 5:
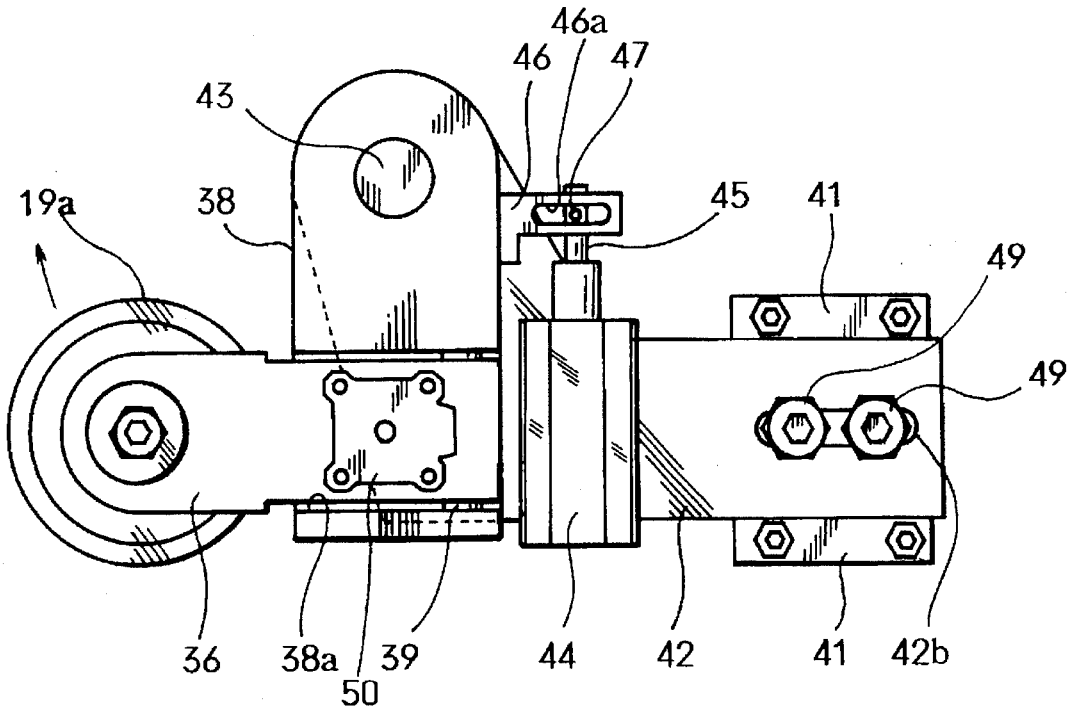
FIG. 5 is a plan view of a second guide roller.
Figure 6:
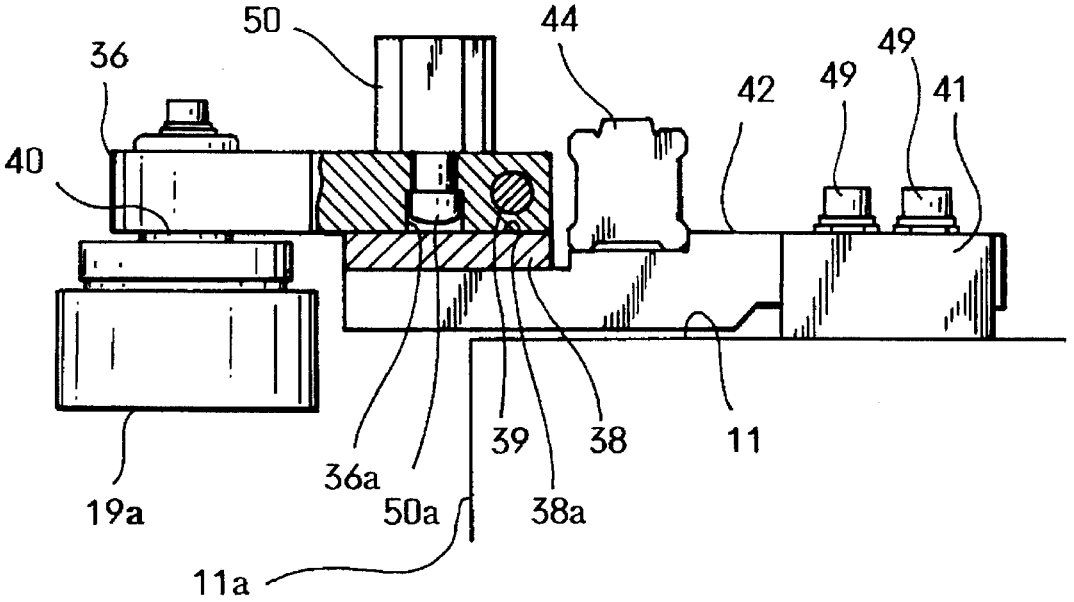
FIG. 6 is a partial side sectional view of the second guide roller.

In FIG. 5, the guide roller 19*a* is located at a holding position, namely in a position to contact the carrying plate 20. In that state, the rod 45 of the cylinder unit 44 is extended. On the other hand, if the rod 45 of the cylinder unit 44 is retracted, the guide roller 19*a* is rotated on the shaft 43 to leave the center roller 16 and move to a free position, to release the carrying plate 20.

When the guide roller 19*a* is moved to the free position by extending the rod 50*a* of the cylinder unit 50, an interference between the carrying plate 20 and the guide roller 19*a* can be avoided, so that the carrying plates 20 can be supplied onto and taken out from the polishing plate 14. In FIG. 6, the guide roller 19*a* is descended and located at a holding position. The carrying plate 20 is rotatably held by the center roller 16 and the guide roller 19*a*.

Successively, a method of polishing the wafers 22 by the machine 10 will be explained.

Firstly, the carrying plates 20 holding the wafers 22 are supplied onto the polishing plate 14.

In FIG. 1, a position D is a supplying position of the carrying plate 20. The guide rollers 18*a*, 18*b*, 18*c* and 18*d* are previously ascended; the guide rollers 19*a*, 19*b*, 19*c* and 19*d* are rotated outward on the shafts 43 to separate away from the polishing plate 14 and ascended. The polishing plate 14 is rotated in the direction X, and the guide roller 18*b* is moved to the holding position.

A first carrying plate 20, holding the wafers 22, is supplied onto the position D of the polishing plate 14 rotating by a supplying mechanism (not shown). The first carrying plate 20 is rotated together with the polishing plate 14 until a position A at which the first carrying plate 20 is held between the guide roller 18*b* and the center roller 16. Afterwards the guide roller 19*b* is descended and rotated toward the holding position, so that the first carrying plate 20 is rotatably held by the center roller 16 and the guide rollers 18*b* and 19*b*.

Next, the guide roller 18*c* is descended toward the holding position, and a second carrying plate 20 is supplied onto the position D. Then the second carrying plate 20 is held by the center roller 16 and the guide roller 18*c* at a position B. Afterwards the guide roller 19*c* is descended and rotated toward the holding position, so that the second carrying plate 20 is rotatably held by the center roller 16 and the guide rollers 18*c* and 19*c*.

Next, the guide roller 18*d* is descended toward the holding position, and a third carrying plate 20 is supplied onto the position D. Then the third carrying plate 20 is held by the center roller 16 and the guide roller 18*d* at a position C. Afterwards the guide roller 19*d* is descended and rotated toward the holding position, so that the third carrying plate 20 is rotatably held by the center roller 16 and the guide rollers 18*d* and 19*d*.

Finally, the guide roller 18*a* is descended toward the holding position, and a fourth carrying plate 20 is supplied onto the position D. Then the fourth carrying plate 20 is held by the center roller 16 and the guide roller 18*a* at a position D. Afterwards the guide roller 19*a* is descended and rotated toward the holding position, so that the fourth carrying plate 20 is rotatably held by the center roller 16 and the guide rollers 18*a* and 19*a*.

The press heads 24, shown in FIG. 2, for each carrying plate 20 are descended so as to press the four carrying plates 20 onto the polishing plate 14. By pressing the carrying plates 20, the wafers 22 are polished. Note that, since the polishing plate 14 is rotated in the direction X, the carrying plates 20, which are rotatably held by the center roller 16 and the guide rollers 18*a*, 18*b*, 18*c* and 18*d*, rotate on their own axes together with the press heads 24, so that lower faces of the wafers 22 are polished.

The polishing is executed by rotating the polishing plate 14 in the direction X for predetermined time. Afterwards the press heads 24 are ascended, and the rotation of the polishing plate 14 is once stopped. Then the motor 56 is driven in the other direction so as to rotate the polishing plate 14 in the direction Y. The press heads 24 for each carrying plate 20 are descended again so as to press the carrying plates 20 onto the polishing plate 14 and polish the wafers 22. Note that, it is not always necessary to ascend the press heads 24 when the rotational direction of the polishing plate 14 is changed.

While the polishing plate 14 is rotated in the direction Y, the carrying plates 20 are rotatably held between the center roller 16 and the guide rollers 19*a*, 19*b*, 19*c* and 19*d*.

If the polishing by rotating the polishing plate 14 in the direction Y has been executed for predetermined time, the polishing is completed. The press heads 24 are ascended by the time the polishing plate 14 stops. The rotational direction of the polishing plate 14 is switched once in the present embodiment but it may be switched a plurality of times.

By switching the rotational direction of the polishing plate 14 while polishing, slury, which is apt to be collected at specific positions, e.g., corners of the orientation flat, of the wafers 22, is uniformly scattered, so that partial over-polishing of the wafers 22 can be prevented effectively.

After completing the polishing, the carrying plates 20 are taken out from the polishing plate 14. The carrying plates 20 are discharged at the position A by a discharging mechanism (not shown).

While the carrying plates 20 are discharged, the polishing plate 14 is rotated in the direction X. The guide roller 19*b* of the position A is previously rotated outward on the shaft 41 and ascended. Then the carrying plate 20, at the position A, is taken out to discharge.

Next, the guide roller 19*c* of the position B is ascended, then the carrying plate 20, at the position B, is rotated together with the polishing plate until reaching the position A. At the position A, the carrying plate 20 is held by the center roller 16 and the guide roller 18*b*. Then the carrying plate 20 is taken out to discharge as well as the former one.

Next, the guide roller 19*c* of the position B is rotated outward and ascended, and the guide roller 18*d* of the position C is ascended. Then the carrying plate 20, at the position C is rotated together with the polishing plate until arriving at the position A. At the position A, the carrying plate 20 is taken out to discharge as well as the former ones.

Finally, the carrying plate 20 at the position D is also discharged as were the former ones.

The above described manner of supplying and discharging the carrying plates 20 is an example, so the supplying position and the discharging position may be optionally changed.

In the present embodiment, the wafers 22 are stuck on the lower faces of the carrying plates 20, but the wafers 22 may be accommodated in cavities, which are formed on the lower faces of the carrying plates 20.

In the present embodiment, the center roller 16 is suspended by the head 10*a*, but the center roller 16 may be rotatably projected from a center of the polishing plate 14.

Figure 7:
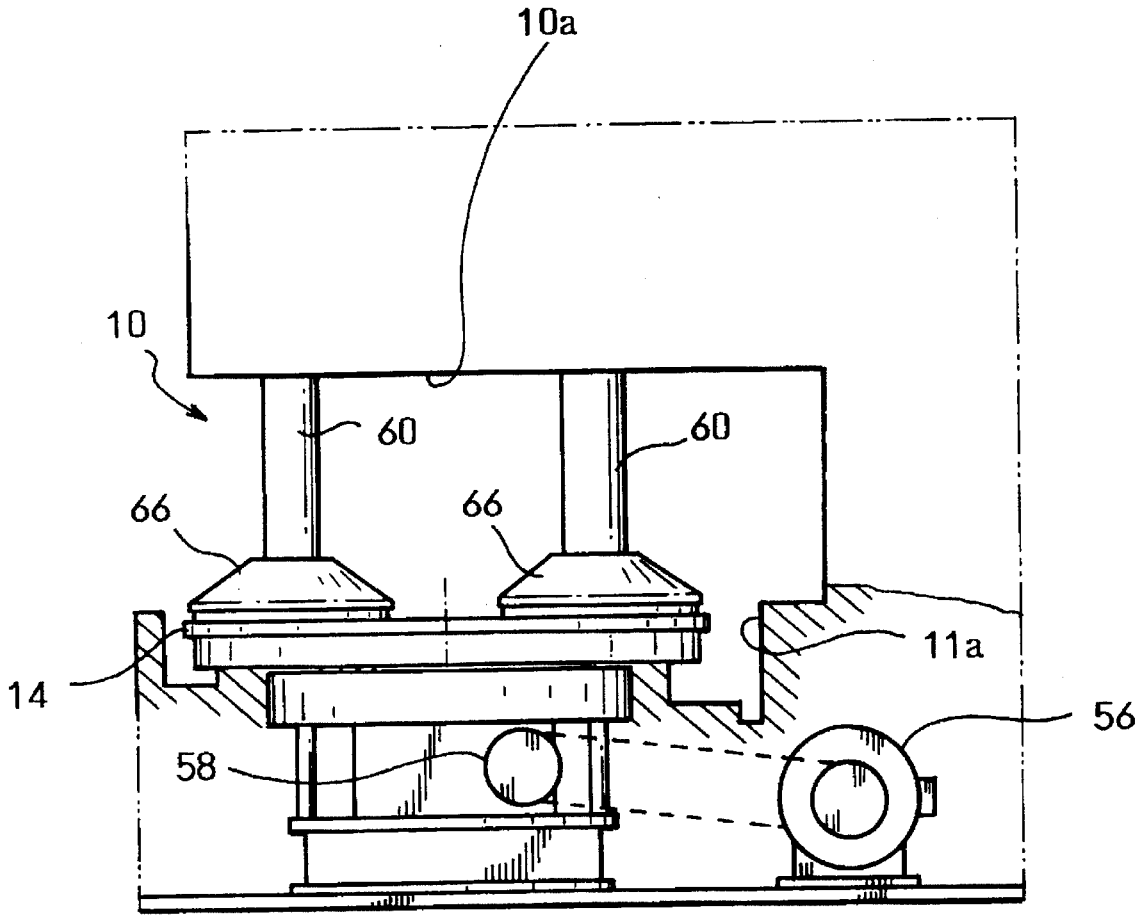
FIG. 7 is an explanation view showing a second embodiment.

Successively, a second embodiment will be described with reference to FIGS. 7 and 8. The machine in this embodiment has no center roller 16 and the guide roller sets.

The carrying plates 20 are held by the press heads 24, and the wafers 22 are polished by the polishing plate 14.

Figure 8:
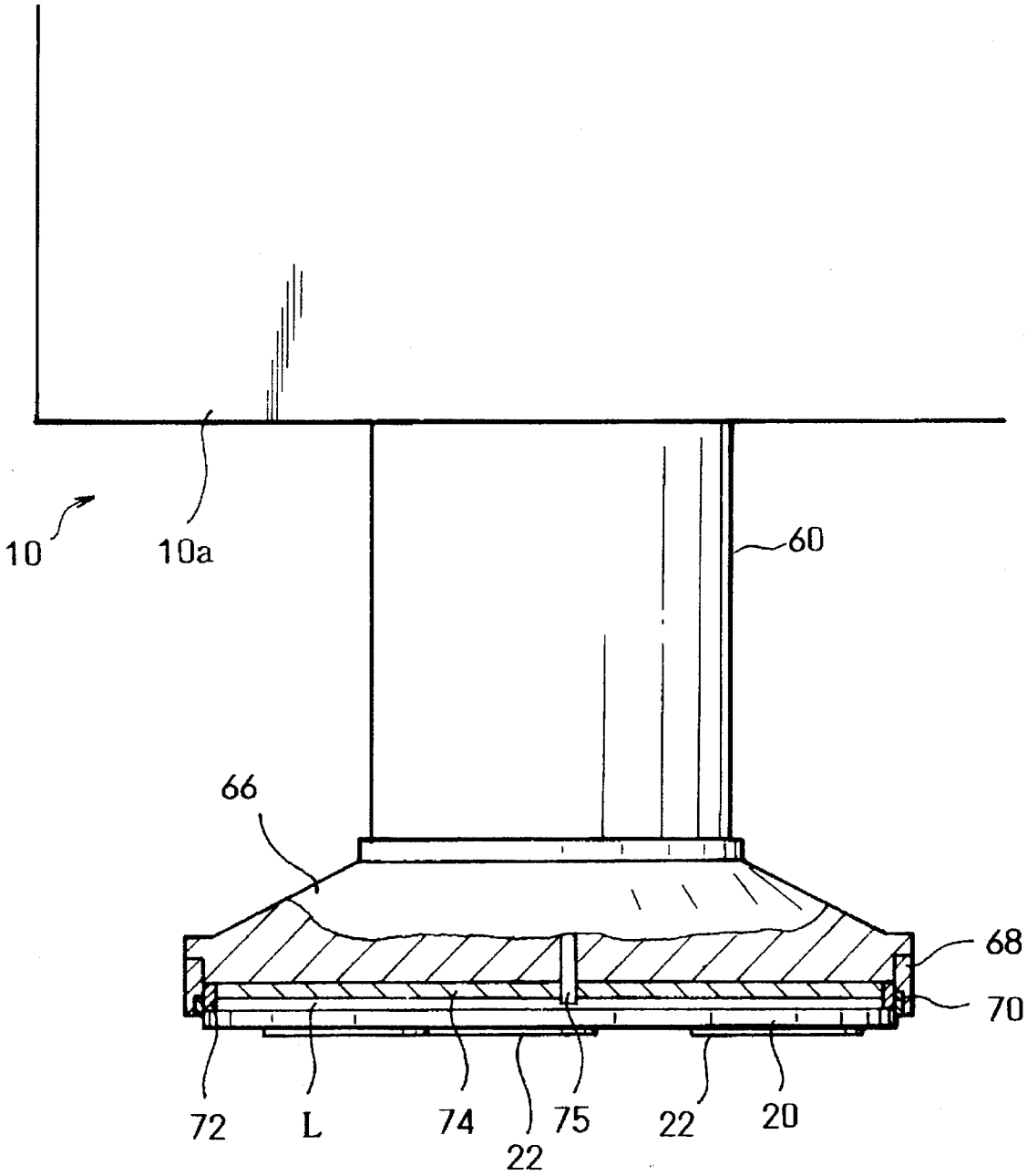
FIG. 8 is an explanation view showing a press head of the second embodiment.

FIG. 8 is a sectional view of the press head 66.

Elevating rods 60 are capable of vertically moving with respect to the head 10*a* of the polishing machine 10. There are rotatable rods (not shown), which are rotatably supported by bearings, in each elevating rod 60. The press heads 66 are provided at lower end of each rotatable rod, so that each press head 66 is capable of rotating together with the rotatable rod.

There is provided an outer ring 68 on a lower outer circumferential face of the press head 66. There is provided a guide ring 70 on a lower inner circumferential face of the outer ring 68. There is further provided a friction ring 72 on the inner circumferential face thereof. The carrying plate 20 holding the wafers 22 is guided by the guide ring 70, so that an upper edge of the carrying plate 20 contacts the friction ring 72.

There is a space L between a plate 74, which is provided on a lower face of the press head 66, and the carrying plate 20. The space L is connected to a vacuum system (not shown) by a tube 75 to apply suction to carrying plate 20. A lower end of the carrying plate 20 is projected downward from the outer ring 68.

The press heads 66, applying suction to the carrying plates 20, are descended onto the polishing plate 14 rotating so as to press the wafers 22, which are held on the lower face of the carrying plates 20, thereonto. Note that, the press heads 66 and the rotatable rods are rotated in the same direction while polishing the wafers 22.

To polish the wafers 22, firstly the polishing plate 14 is rotated in one direction for a predetermined time. Then the press heads 66 are ascended, and the polishing plate 14 is stopped. Next, the polishing plate 14 is rotated in the other direction, and the press heads 66 are descended again to polish the wafers 22.

In the second embodiment, too, slury can be uniformly scattered, so that partial over-polishing of the wafers 22 can be prevented effectively.

Besides the embodiments, the wafers may be directly sucked on the lower faces of the press heads, or fixed thereon by adhesives, etc. In this case, too, the rotational direction of the polishing plate is switched while polishing the wafers.

In machines wherein the press heads are forced to rotate and reciprocally moved between the center part and the outer edge of the polishing plate to polish the wafers, the rotational direction of the polishing plate is switched, and the rotational direction of the press heads may be switched according to that of the polishing plate.

Figure 9:
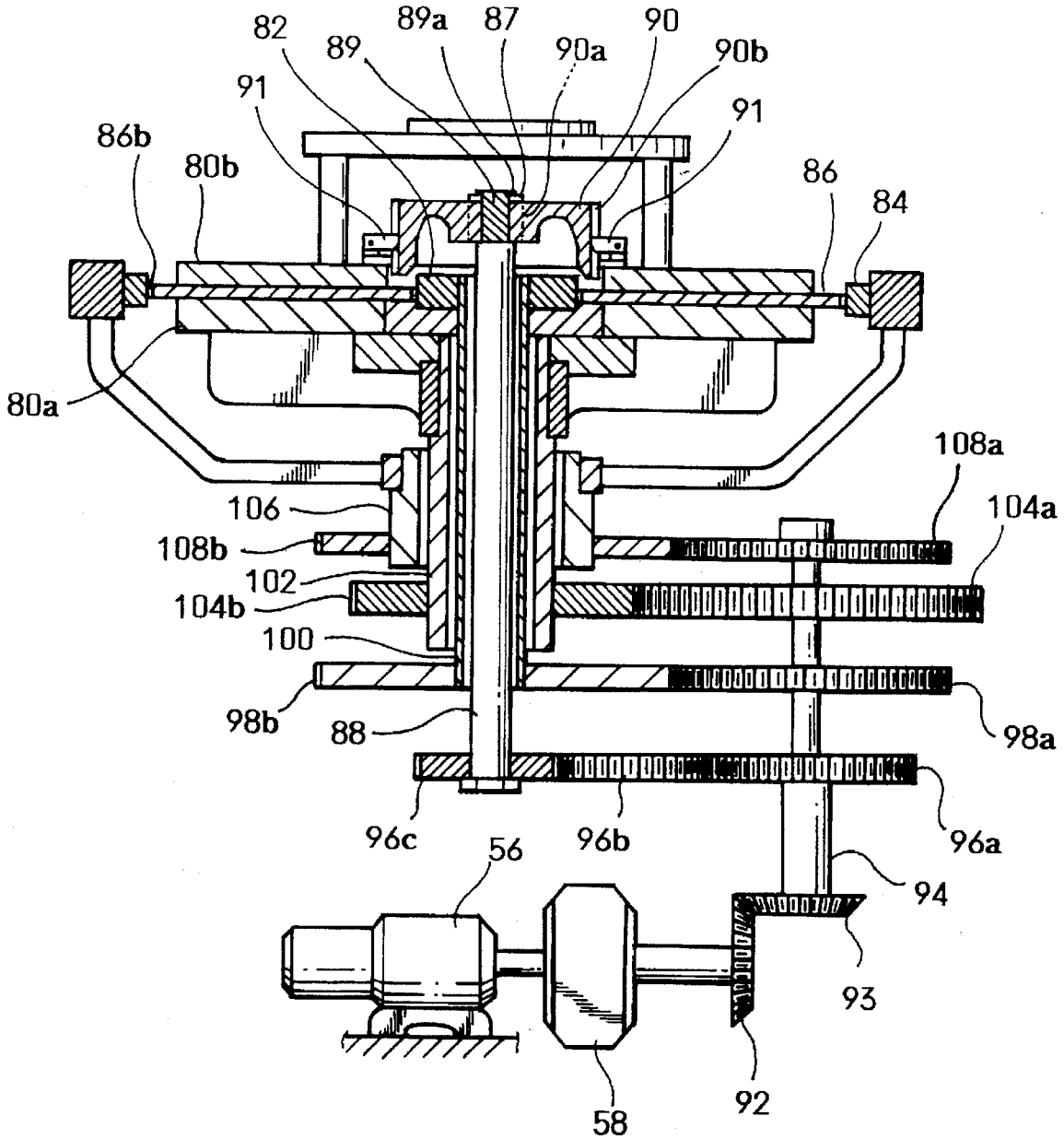
FIG. 9 is a side view of a drive mechanism of a third embodiment.
Figure 10:
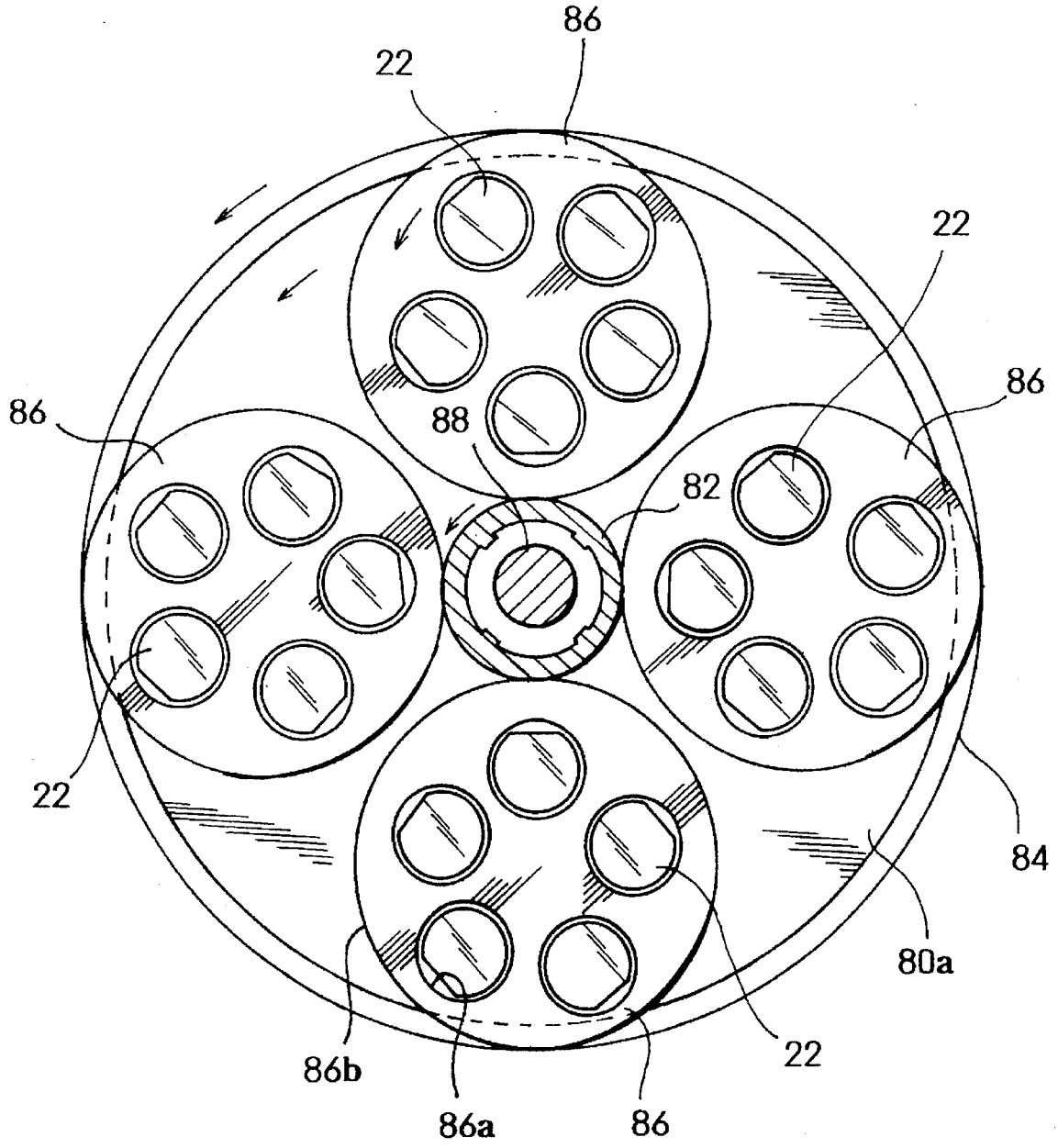
FIG. 10 is a plan view of a lower polishing plate of the third embodiment on which carrying plates are set.

Successively, a third embodiment will be explained with reference to FIGS. 9 and 10. FIG. 9 is a side view of a drive mechanism, and FIG. 10 is a plan view of a lower polishing plate on which carrying plates are set.

The polishing machine 110 has a lower polishing plate 80*a*, an upper polishing plate 80*b*, a center gear 82 and an internal gear 84. Carrying plates 86 are capable of holding wafers 22 in through-holes 86*a*. There are formed gear teeth 86*b* on outer circumferential faces of the carrying plates 86. The gear teeth 86*b* are engaged with the center gear 82 and the internal gear 84.

The upper polishing plate 80*b* is rotated by transmitting members 89 and 90 and a hook 91, which are fixed to an upper end portion of a rotary shaft 88, which is provided coaxial to the upper polishing plate 80*b*. Since the transmitting members 89 and 90 are integrated by a key 87, which is inserted into key grooves 89*a* and 90*a*, the transmitting members 89 and 90 can be rotated together. Further, there are formed engage grooves 90*b* on an outer circumferential face of the transmitting member 90. The hook 91, which is provided on the upper engage plate 80*b*, is capable of engaging with the engage grooves 90*b*.

Driving force is transmitted to a drive shaft 94 from the motor 56 via the reduction mechanism 58 and transmission gears 92 and 93. The driven shaft 94 is provided parallel to the center rotary shaft 88. The driving force transmitted to the driven shaft is further transmitted to the rotary shaft 88 via transmission gears 96*a*, 96*b* and 96*c*, so that the upper polishing plate 80*b* is rotated. The center gear 82 is fixed to an upper end of a cylindrical shaft 100, which covers over the rotary shaft 88. The driving force is transmitted to the cylindrical shaft 100 via transmission gears 98*a* and 98*b*, which are provided on the driven shaft 94, so that the center gear 82 is rotated.

A cylindrical shaft 102, which covers over the cylindrical shaft 100, drives the lower polishing plate 80*a*. The driving force is transmitted to the cylindrical shaft 102 via transmission gears 104*a* and 104*b*, which are provided on the driven shaft 94, so that the lower polishing plate 80*a* can be rotated. Furthermore, a cylinder shaft 106 covers over the cylindrical shaft 102 to drive the internal gear 84. The driving force is transmitted to the cylindrical shaft 106 via transmission gears, 108*a* and 108*b*, to rotate the internal gear 84.

The lower polishing plate 80*a*, the center gear 82 and the internal gear 84 rotates in the same direction. But the upper polishing plate 80*b* rotates in the opposite direction because of the transmission gears 96*a*, 96*b* and 96*c*. Note that, the upper polishing plate 80*b* is capable of moving to and away from the lower polishing plate 80*a* by a conventionally known mechanism (not shown).

Next, the action of the polishing machine 110 will be explained.

When wafers 22 are set, the carrying plates 86 are provided on the lower polishing plate 80*a*, and the wafers 22 are placed in the through-holes 86*a*. Then the upper polishing plate 80*b* is descended to press both faces of each wafer 22 by the lower and the upper polishing plates 80*a* and 80*b*. The lower polishing plate 80*a*, the upper polishing plate 80*b*, the center gear 82 and the internal gear 84 are driven and the slury is supplied to polish the wafers 22. During the action, the carrying plates 86 rotate and orbit, so that the lower and the upper faces of the wafers 22 are polished by the lower and the upper polishing plates 80*a* and 80*b*.

After the prescribed time has passed, the force of the upper polishing plate 80*b* for pressing the wafers 22 is reduced, and the motor 56 is stopped. Then the motor 56 is driven again to rotate in the opposite direction. Since the lower and the upper polishing plates 80*a* and 80*b* are rotated in the one direction and the other direction, the slurry supplied is scattered, so that the over polishing at corners of the orientation flat can be prevented.

Figure 11:
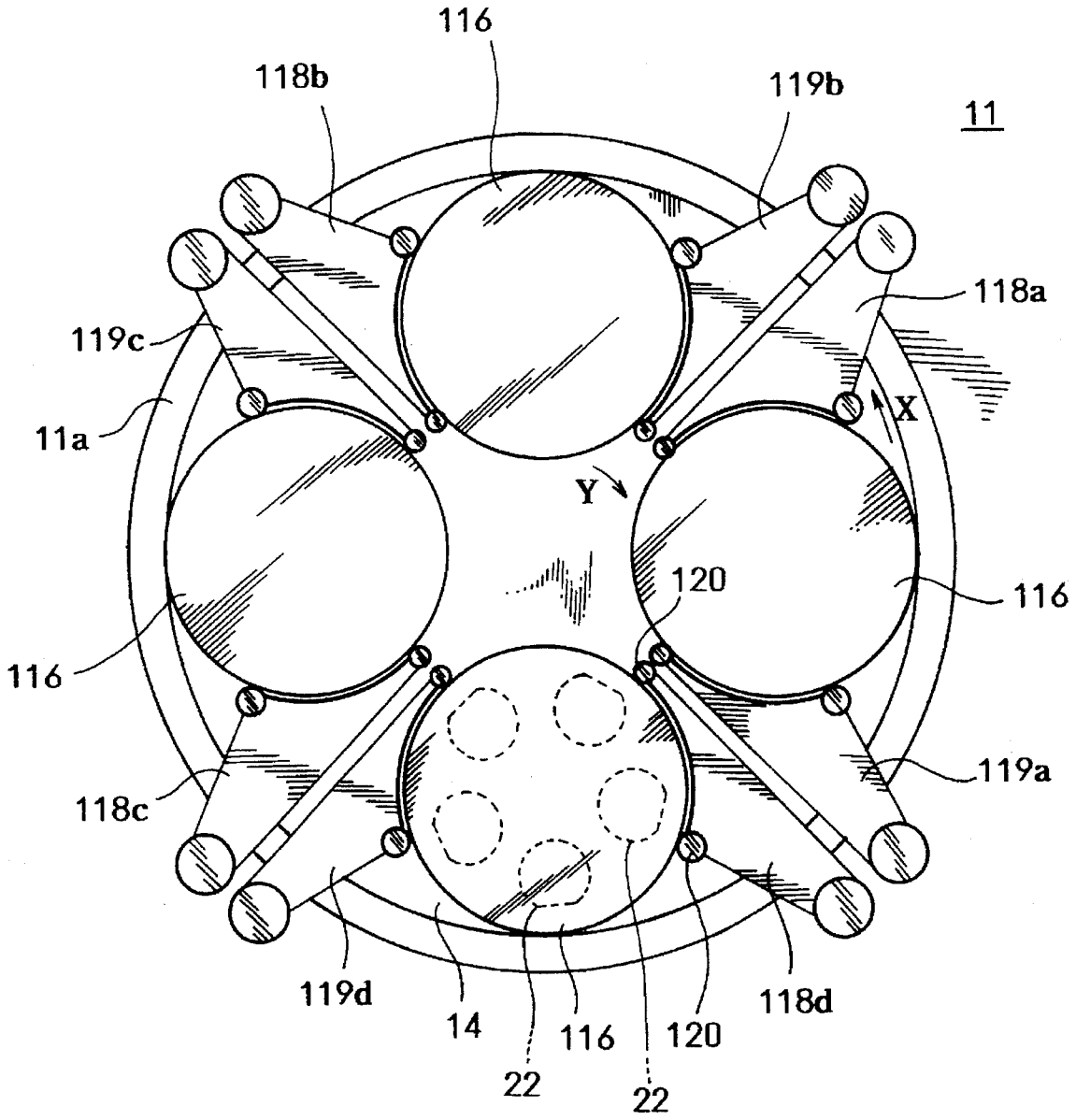
FIG. 11 is a plan view of a fourth embodiment.
Figure 12:
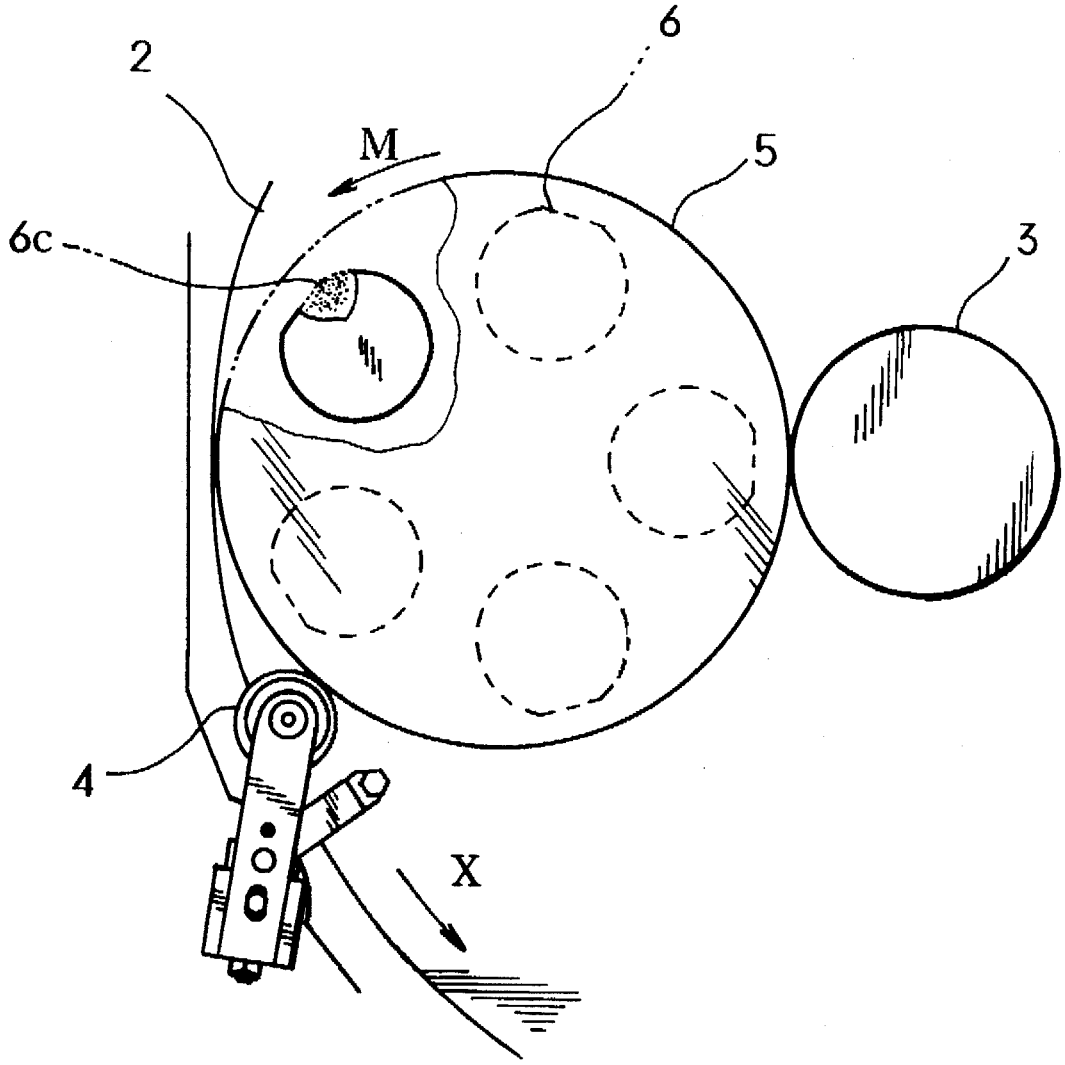
FIG. 12 PRIOR ART
FIG. 12 is a partial plan view of the conventional polishing machine.

Successively, a third embodiment will be explained with reference to FIG. 11.

In the present embodiment, the polishing plate 14 is rotatably provided in the concave section 11*a* of the base 11 as well as the first embodiment (see FIG. 1). The polishing plate 14 is capable of rotating in the one direction and the opposite direction. Guide members 118*a*, 118*b*, 118*c*, 118*d*, 119*a*, 119*b*, 119*c* and 119*d* are extended over the polishing plate 14 from the base 11. The guide members are capable of holding the carrying plates 116, which hold the wafers 22 on the bottom faces. When the polishing plate 14 is rotated in the direction X, the carrying plates 116 are rotatably held by the guide members 118*a*, 118*b*, 118*c* and 118*d*; when the polishing plate 14 is rotated in the opposite direction Y, the carrying plates 116 are rotatably held by the guide members 119*a*, 119*b*, 119*c* and 119*d*.

Structures of the guide members 118*a*, 118*b*, 118*c*, 118*d*, 119*a*, 119*b*, 119*c* and 119*d* are almost same. The guide member 118*a*, 118*b*, 118*c*, 118*d*, 119*a*, 119*b*, 119*c* and 119*d* have curved sections at front end portions. There are provided two rollers 120 at corners of each curved section. The rollers 120 are capable of holding outer circumferential faces of the carrying plates 116. The wafers 22 are pressed onto the polishing plate 14 by the weight of the carrying plates 116. The carrying plate 116 of the present embodiment has the function of the press heads of the first embodiment but press heads for pressing the carrying plates 116 may be provided to the machine of the present embodiment if required.

In the present embodiment too, the slurry supplied is scattered by rotating the polishing plate 14 in the one direction and the other direction, so that the over polishing at corners of the orientation flat of the wafers 22 can be prevented.

In the above described embodiments, the wafers have the linear orientation flats. In cases of wafers having the notched too, the over polishing in the vicinity of the notches can be prevented.

Aside from the polishing plate which is capable of rotating in the one direction and the other direction, the polishing machine of the present invention may have other types of polishing mechanisms.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing machine comprising:

a rotatable polishing plate for polishing a workpiece pressed thereon, said polishing plate being supported by a means for rotating said polishing plate;

a driving mechanism for driving said means for rotating said polishing plate;

said driving mechanism including means for rotating said polishing plate in one direction and another direction, wherein said rotating means stops the rotation of said polishing plate when rotating in the one direction to rotate the polishing plate in the other direction while polishing the workpiece; and a means for pressing said workpiece upon said polishing plate.

2. The polishing machine according to claim 1 wherein said means for pressing is a press head disposed to press said workpiece onto said polishing plate.

3. The polishing machine of claim 2, further comprising said press head including means for holding a holding member and said holding member including means for holding said workpiece.

4. A polishing machine comprising:

a rotatable polishing plate for polishing a workpiece pressed thereon, said polishing plate being supported by a means for rotating said polishing plate;

a driving mechanism for driving said means for rotating said polishing plate;

said driving mechanism including means for rotating said polishing plate in one direction and another direction, wherein said rotating means stops the rotation of said polishing plate when rotating in the one direction to rotate the polishing plate in the other direction while polishing the workpiece;

a means for pressing said workpiece upon said polishing plate;

said means for pressing being a press head disposed to press said workpiece onto said polishing plate;

said press head including means for holding a holding member;

said holding member including means for holding said workpiece;

a center roller disposed in a center of said polishing plate;

means for rotating said center roller coaxially with said polishing plate;

a first guide roller disposed proximate said polishing plate;

means for biasing said first guide roller to rotatably clamp said holding member in conjunction with said center roller while said polishing plate rotates in the one direction;

a second guide roller disposed proximate said polishing plate; and means for biasing said second guide roller to rotatably clamp said holding member in conjunction with said center roller while said polishing plate rotates in the other direction.

5. The polishing machine according to claim 4, further comprising:

means for moving one of said first guide roller and said second guide roller relative to said center roller; and said means for moving permitting displacement of said one of said first guide roller and said second guide roller from said center roller to allow passage of said holding member through a space between said center roller and said one of said first guide roller and said second guide roller.

6. The polishing machine according to claim 1, further comprising another polishing plate for polishing an opposite face of said workpiece.

7. A method of polishing a workpiece comprising the steps of:

pressing said workpiece onto a polishing plate having means for rotating in one direction and another direction;

rotating said polishing plate in the one direction; and rotating said polishing plate in the other direction.

8. A method of polishing a workpiece comprising the steps of:

pressing said workpiece onto a polishing plate having means for rotating in one direction and another direction;

rotating said polishing plate in the one direction;

rotating said polishing plate in the other direction;

reducing a force pressing said workpiece onto said polishing plate when the rotation of said polishing plate is stopped to change the rotational direction.

9. The polishing machine of claim 1 wherein said means for pressing includes a second polishing plate for pressing said one face of said workpiece onto said first polishing plate and polishing an opposite face of said workpiece.

10. A polishing machine comprising:

a rotatable polishing plate having a polishing face for polishing a face of a workpiece;

a base including a driving mechanism for rotating said polishing plate in one direction and another direction;

a press head;

means for pressing the face of said workpiece onto said polishing face using said press head;

a holding member for holding said workpiece beneath said press head;

driving means for rotating said holding member upon said polishing plate;

a first guide member disposed proximate said polishing plate preventing movement of said holding member due to the rotation of said polishing plate in said one direction, said holding member being held at a prescribed position while said polishing plate rotates; and a second guide member disposed proximate said polishing plate preventing movement of said holding member due to the rotation of said polishing plate in said another direction, said holding member being held at the prescribed position while said polishing plate rotates.

11. A polishing machine comprising:

a rotatable polishing plate having a polishing face for polishing a face of a workpiece;

a base including a driving mechanism for rotating said polishing plate in one direction and another direction;

a press head;

means for pressing the face of said workpiece onto said polishing face using said press head;

a holding member for holding said workpiece beneath said press head;

driving means for rotating said holding member upon said polishing plate;

a first guide member disposed proximate said polishing plate preventing movement of said holding member due to the rotation of said polishing plate in said one direction, said holding member being held at a prescribed position while said polishing plate rotates;

a second guide member disposed proximate said polishing plate preventing movement of said holding member due to the rotation of said polishing plate in said another direction, said holding member being held at the prescribed position while said polishing plate rotates;

said driving means for rotating said holding member being a center roller disposed at center of said polishing plate;

said first guide member being a first guide roller with means for rotatably clamping said holding member in conjunction with said center roller while said polishing plate rotates in said one direction; and said second guide member being a second guide roller with means for rotatably clamping said holding member in conjunction with said center roller while said polishing plate rotates in said another direction.

12. A polishing machine comprising:

a rotatable polishing plate having a polishing face for polishing faces of workpieces, said rotatable polishing plate being mounted on a base;

a driving mechanism for rotating said polishing plate in one direction and another direction;

a plurality of press heads having means for accepting said workpieces;

means for rotating said press heads;

an elevating rod coupling said base and said press heads; and means for actuating said elevating rod to vertically move said press heads and to position and hold said press heads at prescribed positions while said polishing plate rotates in the one direction or the other direction.

13. A method of polishing a workpiece comprising the steps of:

situating said workpiece in a means for holding said workpiece applying a force to press a face of said workpiece onto a polishing plate rotating in one direction so as to polish the face of said workpiece by pressing said means for holding towards said polishing plate;

stopping the rotation of said polishing plate; and rotating said polishing plate in the other direction to polish the face of said work without removing said workpiece from said holding means.

14. A method of polishing a workpiece comprising the steps of:

situating said workpiece in a means for holding said workpiece applying a force to press a face of said workpiece onto a polishing plate rotating in one direction so as to polish the face of said workpiece by pressing said means for holding towards said polishing plate;

stopping the rotation of said polishing plate and reducing said force pressing said workpiece onto said polishing plate when the rotation of said polishing plate in the one direction is stopped; and rotating said polishing plate in the other direction to polish the face of said workpiece without removing said workpiece from said holding means.

15. A method of polishing works comprising the steps of:

situating workpieces in a means for holding said workpieces;

said means for holding including holding members for holding a plurality of said workpieces;

mounting a plurality of said holding members, with said workpieces situated on bottom faces thereof, onto a polishing face of a polishing plate capable of rotating in one direction and another direction;

applying a force to rotatably and independently press said holding members using a press head to press the faces of said workpieces onto the polishing face of said polishing plate;

rotating said polishing plate in said one direction to polish said workpieces;

preventing movement of said holding members in response to the rotation of said polishing plate to hold said holding members at prescribed positions;

stopping the rotation of said polishing plate;

rotating said polishing plate in said another direction to polish said workpieces without detaching said workpieces from said holding members; and preventing movement of said holding members in response to the rotation of said polishing plate to hold said holding members at prescribed positions.

16. A method of polishing works comprising the steps of:

situating workpieces in a means for holding said workpieces;

said means for holding including holding members for holding a plurality of said workpieces;

mounting a plurality of said holding members, with said workpieces situated on bottom faces thereof, onto a polishing face of a polishing plate capable of rotating in one direction and another direction;

applying a force to rotatably and independently press said holding members using a press head to press the faces of said workpieces onto the polishing face of said polishing plate;

rotating said polishing plate in said one direction to polish said workpieces;

stopping the rotation of said polishing plate;

rotating said polishing plate in said another direction to polish said workpieces without detaching said workpieces from said holding members;

preventing movement of said holding members in response to the rotation in said one direction of said polishing plate using a first guide member disposed proximate said polishing plate to hold said holding members at prescribed positions; and preventing movement of said holding members in response to the rotation of said polishing plate in said another direction using a second guide member disposed proximate said polishing plate to hold said holding members at the prescribed positions.

17. A method of polishing works comprising the steps of:

situating workpieces in a means for holding said workpieces;

said means for holding including holding members for holding a plurality of said workpieces;

mounting a plurality of said holding members, with said workpieces situated on bottom faces thereof, onto a polishing face of a polishing plate capable of rotating in one direction and another direction;

applying a force to rotatably and independently press said holding members using a press head to press the faces of said workpieces onto the polishing face of said polishing plate;

rotating said polishing plate in said one direction to polish said workpieces;

stopping the rotation of said polishing plate;

rotating said polishing plate in said another direction to polish said workpieces without detaching said workpieces from said holding members;

rotating said holding members with a center roller disposed at a center of said polishing plate;

preventing movement of said holding members from prescribed positions by holding said holding members at the prescribed positions using a first guide roller to prevent the movement of said holding members in response to the rotation of said polishing plate in said one direction; and preventing movement of said holding members from the prescribed positions by holding said holding members at the prescribed positions using a second guide roller to prevent the movement of said holding members in response to the rotation of said polishing plate in said another direction.

18. A method of polishing works comprising the steps of:

situating workpieces in a means for holding said workpieces;

said means for holding including holding members for holding a plurality of said workpieces;

mounting a plurality of said holding members, with said workpieces situated on bottom faces thereof, onto a polishing face of a polishing plate capable of rotating in one direction and another direction;

applying a force to rotatably and independently press said holding members using a press head to press the faces of said workpieces onto the polishing face of said polishing plate;

rotating said polishing plate in said one direction to polish said workpieces;

preventing movement of said holding members in response to the rotation of said polishing plate to hold said holding members at prescribed positions;

stopping the rotation of said polishing plate and reducing said force pressing said workpieces onto said polishing plate when the rotation of said polishing plate in the one direction is stopped;

rotating said polishing plate in said another direction to polish said workpieces without detaching said workpieces from said holding members; and preventing movement of said holding members in response to the rotation of said polishing plate to hold said holding members at the prescribed positions.

19. A method of polishing workpieces comprising the steps of:

mounting said workpieces to bottom surfaces of press heads;

mounting a plurality of said press heads, with said workpieces situated on bottom faces thereof, onto a polishing face of a polishing plate capable of rotating in one direction and another direction;

applying a force to rotatably and independently press said press heads to press the faces of said workpieces onto the polishing face of said polishing plate;

rotating said polishing plate in said one direction to polish said workpieces;

preventing the movement of said press heads in response to the rotation of said polishing plate in said one direction to hold said press heads at prescribed positions;

stopping the rotation of said polishing plate;

rotating said polishing plate in said another direction to polish said workpieces without detaching said workpieces from said press heads; and preventing the movement of said press heads in response to the rotation of said polishing plate in said another direction to hold said press heads at said prescribed positions.

20. The method of polishing according to claim 19, further comprising actuating an elevating rod to vertically move said press heads, to position said press heads to prevent movement of said press heads by the rotation of said polishing plate, and to hold said press heads at said prescribed positions while said polishing plate rotates in said one direction and said another direction.

21. A method of polishing workpieces comprising the steps of:

mounting said workpieces to bottom surfaces of press heads;

mounting a plurality of said press heads, with said workpieces situated on bottom faces thereof, onto a polishing face of a polishing plate capable of rotating in one direction and another direction;

applying a force to rotatably and independently press said press heads to press the faces of said workpieces onto the polishing face of said polishing plate;

rotating said polishing plate in said one direction to polish said workpieces;

preventing the movement of said press heads in response to the rotation of said polishing plate in said one direction to hold said press heads at prescribed positions;

stopping the rotation of said polishing plate and reducing said force pressing said workpieces onto said polishing plate when the rotation of said polishing plate in the one direction is stopped;

rotating said polishing plate in said another direction to polish said workpieces without detaching said workpieces from said press heads; and preventing the movement of said press heads in response to the rotation of said polishing plate in said another direction to hold said press heads at said prescribed positions.

* * * * *

UNITED STATES PATENT AND TRADEMARK OFFICE

CERTIFICATE OF CORRECTION

PATENT NO. : 5,647,789

DATED : July 15, 1997

INVENTOR(S) : Satoru KITTA et al.

It is certified that error appears in the above-indentified patent and that said Letters Patent is hereby corrected as shown below:

On the title page, item [73] Assignees, change "Kakai" to --Kikai--.

Signed and Sealed this

Fourteenth Day of October, 1997

*Attest:*

*Attesting Officer*

BRUCE LEHMAN

*Commissioner of Patents and Trademarks*